US011774900B2

(12) United States Patent
Nakamura

(10) Patent No.: US 11,774,900 B2
(45) Date of Patent: Oct. 3, 2023

(54) SHEET CONVEYING APPARATUS AND IMAGE FORMING SYSTEM

(71) Applicant: CANON KABUSHIKI KAISHA, Tokyo (JP)

(72) Inventor: Michinori Nakamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 17/226,789

(22) Filed: Apr. 9, 2021

(65) Prior Publication Data

US 2021/0323785 A1 Oct. 21, 2021

(30) Foreign Application Priority Data

Apr. 20, 2020 (JP) ..... 2020-074724

(51) Int. Cl.
*G03G 21/16* (2006.01)

(52) U.S. Cl.
CPC ..... *G03G 21/1633* (2013.01); *G03G 21/1619* (2013.01); *B65H 2402/44* (2013.01); *B65H 2402/441* (2013.01); *B65H 2402/80* (2013.01); *B65H 2601/324* (2013.01); *G03G 2221/1654* (2013.01)

(58) Field of Classification Search
CPC ..... B65H 2402/44; B65H 2402/441; B65H 2402/45; G03G 21/1619; G03G 21/1623; G03G 21/1633; G03G 2221/1654
See application file for complete search history.

(56) References Cited

U.S. PATENT DOCUMENTS 9,235,185 B2 * 1/2016 Koyanagi ..... G03G 21/1652

FOREIGN PATENT DOCUMENTS

JP 2009169073 A 7/2009

* cited by examiner

*Primary Examiner* — Jeremy R Severson
(74) *Attorney, Agent, or Firm* — Canon U.S.A., Inc. I.P. Division

(57) ABSTRACT

A sheet conveying apparatus includes a conveyance unit to convey a sheet, a support frame supporting the he conveyance unit and having a mounting member, and an exterior cover made of metal and fixed to the mounting member by a screw. The exterior cover covers the support frame on a back side of the sheet conveying apparatus and includes a hook portion provided above a position corresponding to the mounting member in a vertical direction, and a positioning pin provided below the position corresponding to the mounting member in the vertical direction. The support frame includes an engagement portion, engaged with the hook portion and provided at a position above the mounting member in the vertical direction, and a through-hole, formed at a position below the mounting member in the vertical direction, into which the positioning pin is inserted to position the exterior cover with respect to the support frame.

11 Claims, 20 Drawing Sheets

SHEET CONVEYING APPARATUS AND IMAGE FORMING SYSTEM

BACKGROUND OF THE DISCLOSURE

Field of the Disclosure

The present disclosure relates to a sheet conveying apparatus including an exterior cover mounted to a main body frame, and an image forming system including the sheet conveying apparatus.

Description of the Related Art

Hitherto, an image forming apparatus includes a casing including a main body frame and an exterior cover configured to cover the main body frame. In recent years, the image forming apparatus has been increased in speed, and along with the increase in speed, a main body of the image forming apparatus has been increased in size. Along with the increase in size of the main body of the image forming apparatus, the exterior cover has also been increased in size. In Japanese Patent Application Laid-Open No. 2009-169073, the following configuration is disclosed. Specifically, an exterior cover configured to cover a main body frame of an image forming apparatus is formed of a metal plate, and is caused to function as a stay for right and left side plates of the main body frame. Thus, the number of components is reduced to attain reduction in cost.

In Japanese Patent Application Laid-Open No. 2009-169073, the configuration in which the exterior cover of the image forming apparatus is formed of a metal plate is disclosed. However, in a conveying apparatus configured to convey a sheet, for example, an exterior cover is formed of a metal plate in some cases. For example, the exterior cover is formed of a metal plate in some cases because the production number is small and mold cost is high. Further, in order to suppress radiation noise, the exterior cover is formed of a metal plate in some cases.

When the exterior cover is mounted at a distance from the main body frame, a plurality of mounting members are required. When the exterior cover is mounted to the main body frame through intermediation of the plurality of mounting members, it is difficult to match a plurality of holes formed in the exterior cover and a plurality of screw holes formed in the plurality of mounting members, respectively, in order to allow screws to pass therethrough. Therefore, at the time of assembly at a factory, an assembly operator uses an assembly jig, or at the time of assembly for a maintenance operation, a service person temporarily fastens screws, and then, fixes the exterior cover to the main body frame. Thus, workability is degraded.

SUMMARY OF THE DISCLOSURE

The present disclosure provides a sheet conveying apparatus with improved workability during assembly and maintenance of the sheet conveying apparatus.

According to an aspect of the present disclosure, a sheet conveying apparatus includes a conveyance unit configured to convey a sheet, a support frame provided with a mounting member and configured to support the conveyance unit, and an exterior cover configured to cover the support frame on a back side of the sheet conveying apparatus, where the exterior cover is made of metal and is fixed to the mounting member by a screw, wherein the exterior cover includes a hook portion provided above a position corresponding to the mounting member in a vertical direction, and a positioning pin provided below the position corresponding to the mounting member in the vertical direction, and wherein the support frame includes an engagement portion, provided at a position above the mounting member in the vertical direction, with which the hook portion is engaged, and a through-hole, formed at a position below the mounting member in the vertical direction, into which the positioning pin is inserted to position the exterior cover with respect to the support frame.

Further features of the present disclosure will become apparent from the following description of exemplary embodiments with reference to the attached drawings.

DESCRIPTION OF THE EMBODIMENTS

Now, an embodiment is described with reference to the attached drawings.

(Image Forming System)

Figure 1:
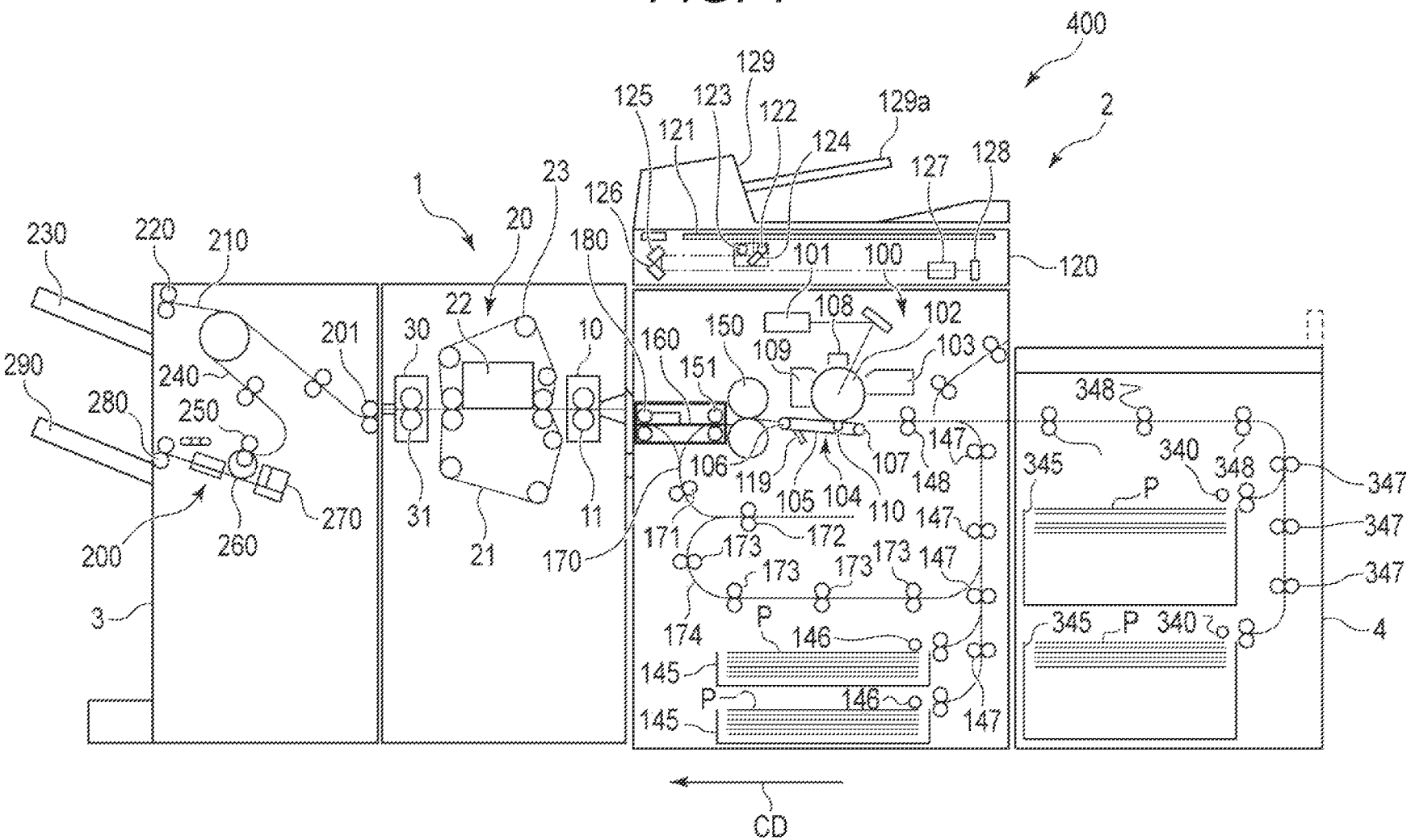
FIG. 1 is a sectional view of an image forming system.

FIG. 1 is a sectional view of an image forming system 400. The image forming system 400 includes a sheet cooling apparatus 1, an image forming apparatus 2, a sheet processing apparatus 3, and an external feeding apparatus 4. The sheet cooling apparatus 1 is a sheet conveying apparatus configured to convey a sheet discharged from the image forming apparatus 2 to the sheet processing apparatus 3. The image forming apparatus 2 is connected to an upstream side of the sheet cooling apparatus 1 in a sheet conveyance direction CD. The sheet processing apparatus 3 being a finisher is connected to a downstream side of the sheet cooling apparatus 1 in the sheet conveyance direction CD. The sheet processing apparatus 3 includes a binding portion 200 configured to bind, by a stapler 270, a sheet having an image formed thereon by the image forming apparatus 2. The external feeding apparatus 4 being a sheet feeding apparatus is connected to an upstream side of the image forming apparatus 2 in the sheet conveyance direction CD. The external feeding apparatus 4 includes sheet decks 345 configured to stack sheets P.

The image forming apparatus 2 includes an image forming portion 100. The image forming portion 100 includes a charging unit 108, an exposure portion 101, a photosensitive drum 102 having a cylindrical shape, a developing device 103, a transfer portion 104, a cleaning member 109, and a fixing device 150. A straight conveyance path 160 including discharge rollers 180 is provided on a downstream side of the image forming portion 100 in the sheet conveyance direction CD. The image forming apparatus 2 includes an image reading apparatus 120. The image reading apparatus 120 includes a platen glass 121 being an original placing platen, a scanner unit 123, and an original feeding apparatus 129 configured to feed an original to the platen glass 121.

The image forming apparatus 2 includes an operation panel (not shown) including a display portion (not shown) configured to display information indicating a setting of various modes and an operation state. The display portion of the operation panel is configured to display contents required to be performed by a user when abnormality such as jam of a sheet occurs. Further, the image forming apparatus 2 includes a controller (not shown) configured to control, in accordance with a predetermined program, the image forming portion 100 and the sheet processing apparatus 3 to operate in accordance with a set operation mode.

The sheet cooling apparatus 1 cools the sheet P heated by the fixing device 150 in the image forming apparatus 2 in order to fix a toner image onto the sheet P. The sheet cooling apparatus 1 includes an upstream-side conveyance guide portion 10, a cooling unit 20, and a downstream-side conveyance guide portion 30. Here, the cooling unit 20 is an example of a conveyance unit configured to convey the sheet received from the image forming apparatus 2 to the downstream side. The upstream-side conveyance guide portion 10 includes a roller pair 11 configured to receive the sheet P discharged by the discharge rollers 180 of the image forming apparatus 2. The cooling unit 20 is arranged on a downstream side of the roller pair 11 in the sheet conveyance direction CD. The cooling unit 20 includes a heatsink 22 configured to cool the sheet, a sheet conveyance belt 21, and a sheet conveyance belt 23. The heatsink 22 is made of aluminum and is in contact with the sheet conveyance belt 23 at a position at which the sheet conveyance belt 21 and the sheet conveyance belt 23 are in contact with each other. The heatsink 22 is cooled by a fan (not shown). The downstream-side conveyance guide portion 30 is arranged on a downstream side of the cooling unit 20 in the sheet conveyance direction CD. The downstream-side conveyance guide portion 30 includes a roller pair 31 configured to receive the sheet.

(Image Reading Operation, Image Forming Operation, and Sheet Processing Operation)

Next, an image reading operation to be performed by the image reading apparatus 120, an image forming operation to be performed by the image forming apparatus 2, and a sheet processing operation to be performed by the sheet processing apparatus 3 are described. When a start button (not shown) is pushed, originals (not shown) stacked on an original tray 129*a* of the original feeding apparatus 129 are conveyed onto the platen glass 121 sequentially one by one by the original feeding apparatus 129. When the original is conveyed, a lamp of a scanner portion 122 turns on, and the scanner unit 123 including the scanner portion 122 moves to illuminate the original.

Light reflected from the original is reflected by mirrors 124, 125, and 126, passes through a lens 127, and is input to a CCD image sensor 128. The reflected light is photoelectrically converted into an electric signal (image data) by the CCD image sensor 128. The electric signal is subjected to various image processes and is input to the exposure portion 101 provided in the image forming apparatus 2. In this embodiment, the electric signal is input from the image reading apparatus 120 to the exposure portion 101. However, this embodiment is not limited thereto, and the electric signal being image data may be input from a personal computer to the exposure portion 101. The exposure portion 101 irradiates a surface of the photosensitive drum 102 with light in accordance with an image signal modulated in accordance with the electric signal (image data) to form an electrostatic latent image on the surface of the photosensitive drum 102. The electrostatic latent image formed on the photosensitive drum 102 is developed with toner into a toner image by the developing device 103.

Meanwhile, in parallel with the image forming operation, for example, the sheets P received in feed cassettes 145 are sequentially fed by feed rollers 146. The sheets P are conveyed to registration rollers 148 by vertical path rollers 147. Further, when the sheets P are to be fed from the sheet decks 345 of the external feeding apparatus 4, the sheets P received in the sheet decks 345 are sequentially fed by feed rollers 340. The sheets P are conveyed to the registration rollers 148 by conveyance rollers 347 and 348. A leading edge of the sheet P is brought into abutment against the registration rollers 148 in a stopped state so that the sheet P forms a loop. The sheet P forms a loop so that the leading edge of the sheet P becomes parallel to a rotation axis of the photosensitive drum 102, thereby correcting skew of the sheet P. The registration rollers 148 are rotated at a predetermined timing. Thus, the sheet P is conveyed to the transfer portion 104 so that the leading edge of the sheet P matches a leading edge of the toner image formed on the photosensitive drum 102.

The transfer portion 104 includes an endless transfer belt 105 and a corona charging device 110. The transfer belt 105 is stretched around a drive roller 106 and a driven roller 107. The corona charging device 110 is arranged on an inner side of the transfer belt 105 so as to be opposed to the photosensitive drum 102. In the transfer portion 104, the sheet P is conveyed while being attracted by the transfer belt 105. A transfer voltage is applied to the corona charging device 110 so that the toner image on the photosensitive drum 102 is transferred onto the sheet P. The cleaning member 109 removes toner or paper dust remaining on the surface of the photosensitive drum 102 while being held in abutment against the surface of the photosensitive drum 102. Further, a cleaning member 119 removes toner or paper dust remaining on a surface of the transfer belt 105 while being held in abutment against the surface of the transfer belt 105.

The sheet P having the toner image transferred thereon is conveyed to the fixing device 150. The fixing device 150 heats and pressurizes the sheet P to fix the toner image onto the sheet P. With this, the image is formed on the sheet P. The sheet P having the image formed thereon passes through the straight conveyance path 160, and is discharged to the sheet cooling apparatus 1 by the discharge rollers 180.

When front and back surfaces of the sheet P are reversed and the sheet P is discharged to the sheet cooling apparatus 1, a conveyance destination of the sheet P discharged from the fixing device 150 is switched to a reversing path 170 by a switching member (not shown) provided on a downstream side of post-fixing rollers 151. The sheet P is conveyed to the reversing path 170, and first reverse rollers 171 and second reverse rollers 172 are stopped such that a rear edge of the sheet P is located at an upstream position by a predetermined amount from the first reverse rollers 171. After that, the first reverse rollers 171 and the second reverse rollers 172 are reversely rotated so that the sheet P is conveyed to the discharge rollers 180. The sheet P whose front and rear surfaces have been reversed is discharged to the sheet cooling apparatus 1 by the discharge rollers 180.

Further, when images are to be formed on both surfaces of the sheet P, the conveyance destination of the sheet P discharged from the fixing device 150 is switched to the reversing path 170 by the switching member (not shown) provided on the downstream side of the post-fixing rollers 151. The sheet P is conveyed to the reversing path 170, and the first reverse rollers 171 and the second reverse rollers 172 are stopped such that the rear edge of the sheet P is located at an upstream position by a predetermined amount from the second reverse rollers 172. Next, the conveyance destination of the sheet P is switched to a re-conveyance path 174 by a switching member (not shown) provided between the second reverse rollers 172 and the re-conveyance path 174. The second reverse rollers 172 are reversely rotated. Thus, the sheet P is conveyed to the re-conveyance path 174, and is conveyed to the vertical path rollers 147 again by duplex printing rollers 173. After that, the sheet P is conveyed to the transfer portion 104 so that an image is formed on a back surface of the sheet P. In this manner, the sheet P having the images formed on both the surfaces passes through the straight conveyance path 160, and is discharged to the sheet cooling apparatus 1 by the discharge rollers 180.

When post-processing such as stapling is not set by an operation unit (not shown), the sheet P having been discharged to the sheet processing apparatus 3 is conveyed to a first conveyance path 210 by inlet rollers 201. The sheet P is discharged to a first sheet stacking tray 230 by first discharge rollers 220 with an image forming surface thereof facing upward, and is stacked. Further, when post-processing such as stapling is set by the operation unit (not shown), the sheet P is conveyed to a second conveyance path 240 and is stacked as a sheet bundle on a sheet processing tray 260 by second discharge rollers 250. The sheet bundle is bound by the stapler 270 and is discharged and stacked onto a second sheet stacking tray 290 by sheet bundle discharge rollers 280.

(Configurations of Main Body Frame and Rear Cover)

Figure 2:
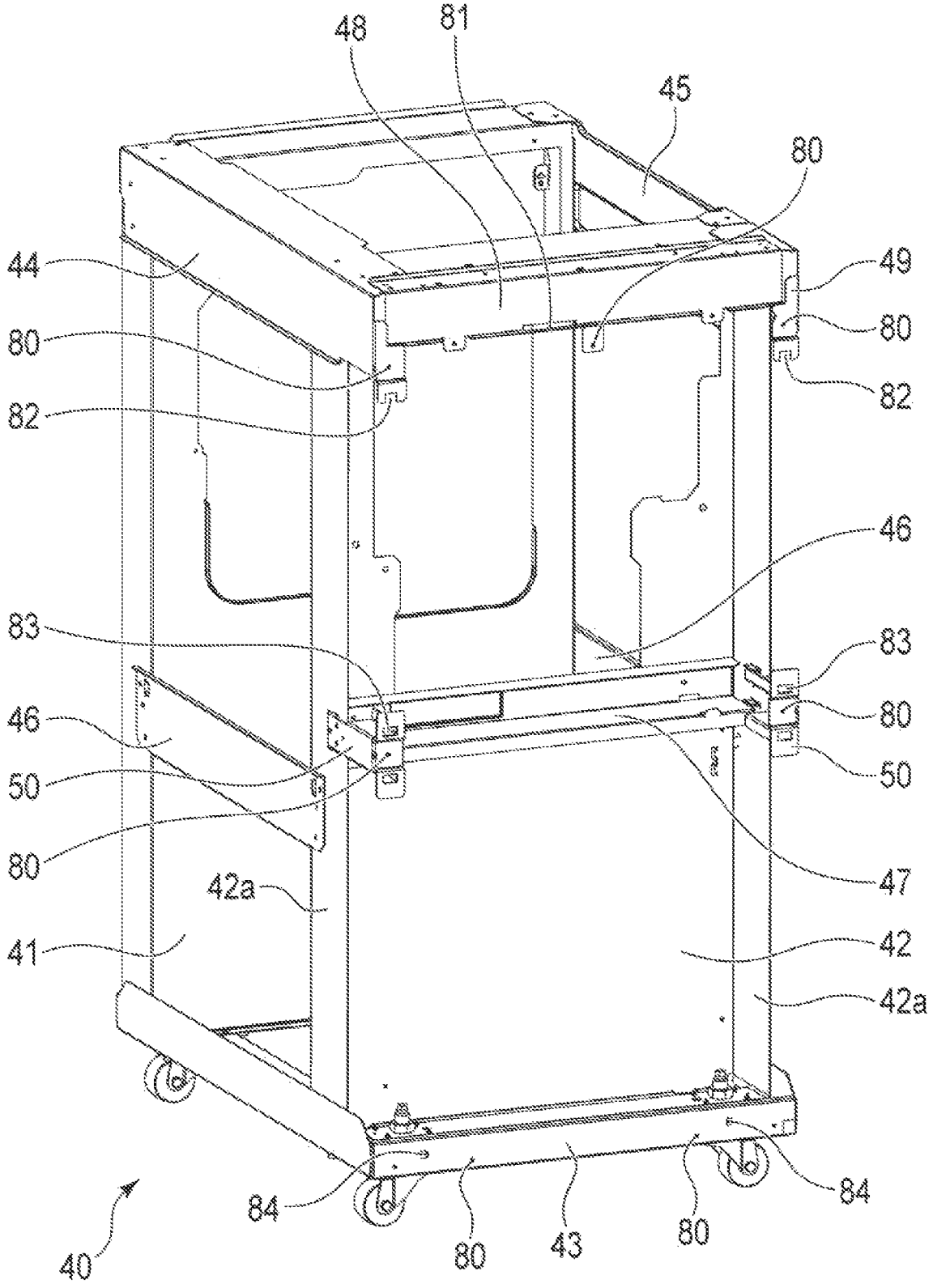
FIG. 2 is a perspective view of a main body frame of a sheet cooling apparatus.
Figure 3:
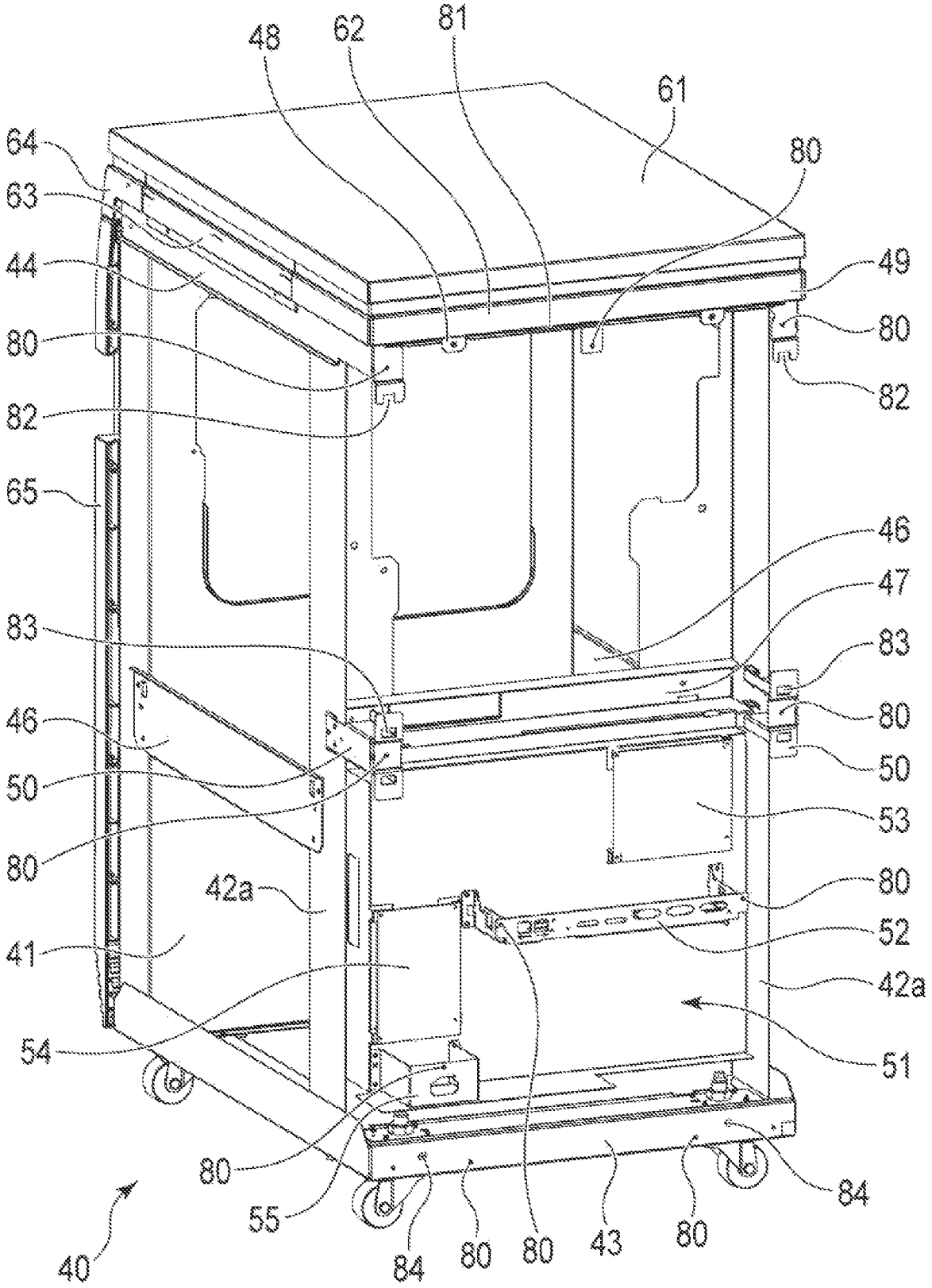
FIG. 3 is a perspective view of the main body frame to which an electrical unit is mounted.
Figure 4:
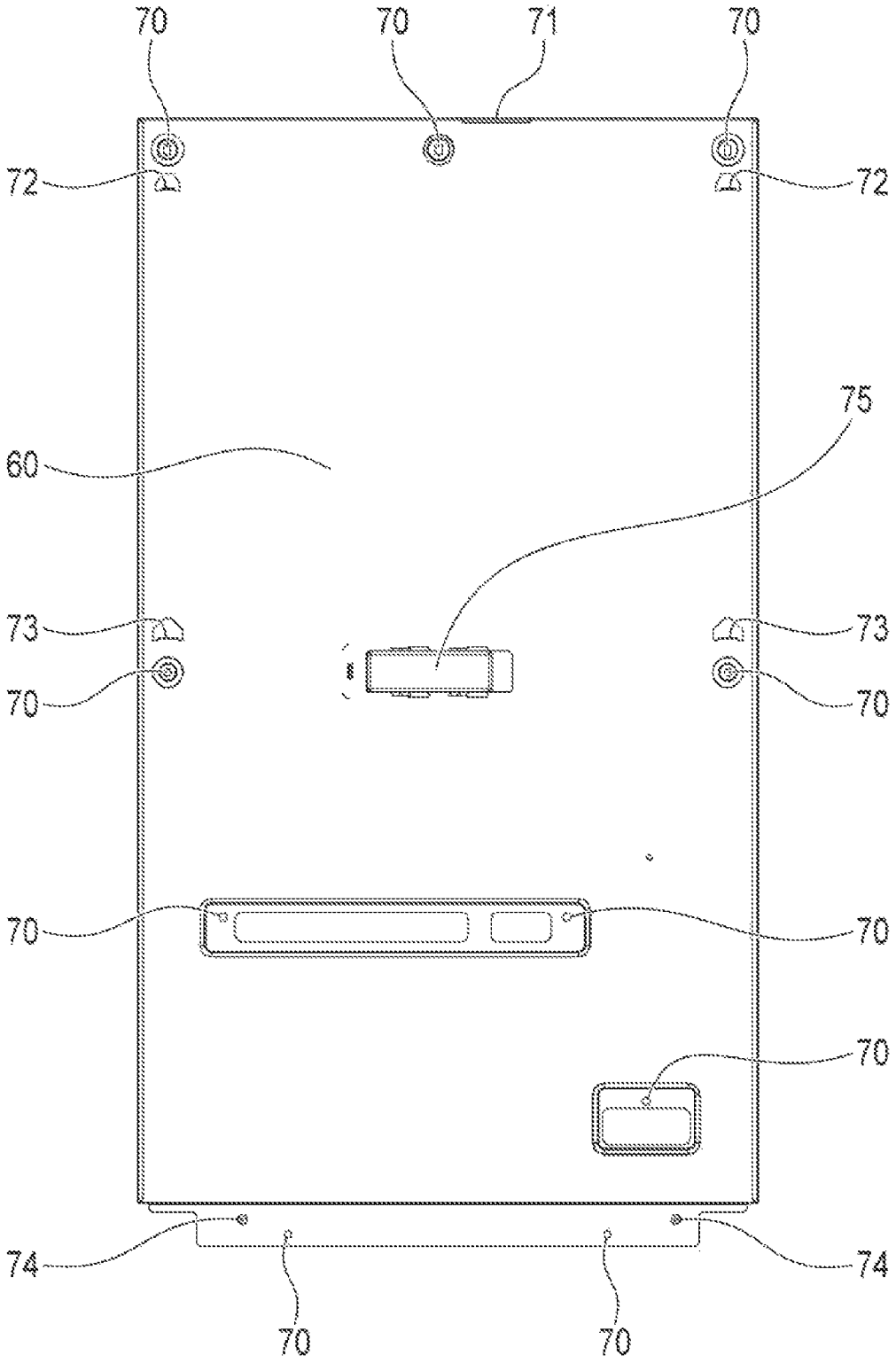
FIG. 4 is a front view of a rear cover.

Now, with reference to FIG. 2, FIG. 3, and FIG. 4, a mounting configuration of a rear cover 60 to a main body frame 40 of the sheet cooling apparatus 1 is described. The main body frame 40 is provided to an apparatus main body of the sheet cooling apparatus 1. FIG. 2 is a perspective view of the main body frame 40 of the sheet cooling apparatus 1. The main body frame 40 includes a bottom plate 43, a front side plate 41, a rear side plate 42, a right upper stay 44, a left upper stay 45, and two side stays 46. The front side plate 41 and the rear side plate 42 are mounted to the bottom plate 43 in an upright posture. An upper portion of the front side plate 41 and an upper portion of the rear side plate 42 are connected to each other by the right upper stay 44 and the left upper stay 45. The vicinity of a center portion of the front side plate 41 and the vicinity of a center portion of the rear side plate 42 are connected to each other by the two side stays 46. The main body frame 40 is assembled with high accuracy by an operator using an assembly jig.

A middle rear stay 47 is mounted to the vicinity of a center portion of the main body frame 40 on the rear side. A rear upper cover mounting plate 48 is mounted to an upper portion of the main body frame 40 on the rear side. Both side portions of the rear side plate 42 are bent so that bent surfaces 42*a* are formed. A first rear cover mounting plate 49 is mounted to an upper portion of the bent surface 42*a* on the left side (right side of FIG. 2). Second rear cover mounting plates (mounting members) 50 are mounted to the vicinities of center portions of the bent surfaces 42*a* on both sides, respectively. The bottom plate 43, the front side plate 41, the rear side plate 42, the right upper stay 44, the left upper stay 45, the two side stays 46, the middle rear stay 47, the rear upper cover mounting plate 48, the first rear cover mounting plate 49, and the two second rear cover mounting plates 50 are each formed of a metal plate having a thickness of from about 0.8 mm to about 2 mm.

The rear upper cover mounting plate 48 has an engagement portion 81. The bottom plate 43, the right upper stay 44, the rear upper cover mounting plate 48, the first rear cover mounting plate 49, and the two second rear cover mounting plates 50 each have a screw hole 80 into which the rear cover 60 (FIG. 4) described later is to be screwed. The right upper stay 44 and the first rear cover mounting plate 49 each include a first catching portion (first opening portion) 82 into which a first insertion portion 72 (FIG. 4) of the rear cover 60 (FIG. 4) is to be inserted. The first rear cover mounting plate 49 includes one screw hole 80 and one first catching portion 82 in the vicinity of the one screw hole 80. In this embodiment, the first catching portion 82 is formed below the screw hole 80 of the first rear cover mounting plate 49.

The second rear cover mounting plates 50 each include a second catching portion (second opening portion) 83 into which a second insertion portion 73 (FIG. 4) of the rear cover 60 (FIG. 4) is to be inserted. Each of the two second rear cover mounting plates 50 has one screw hole 80 and one second catching portion 83 in the vicinity of the one screw hole 80. In this embodiment, the second catching portion 83 is formed above the screw hole 80 of the second rear cover mounting plate 50. The bottom plate 43 has two positioning holes (positioning portions) 84 into which two positioning pins 74 (FIG. 4) for the rear cover 60 (FIG. 4) are to be inserted.

FIG. 3 is a perspective view of the main body frame 40 to which an electrical unit 51 is mounted. As illustrated in FIG. 3, the electrical unit 51 is mounted to the main body frame 40 of the sheet cooling apparatus 1. The electrical unit 51 includes an interface unit 52 for connection with another product, a control board 53 configured to control the sheet cooling apparatus 1, a power board 54, and an inlet unit 55 to be connected to a power cord. The interface unit 52, the control board 53, the power board 54, and the inlet unit 55 are electrically connected to one another by cables (not shown). The interface unit 52 and the inlet unit 55 each have a screw hole 80 through which the rear cover 60 (FIG. 4) described later is to be screwed. An upper cover 61, a rear upper cover 62, a side cover 63, and a front upper cover 64 are screwed to the main body frame 40 or a mounting member (not shown) fixed to the main body frame 40. A front door 65 is rotatably supported on a hinge member (not shown) mounted to the main body frame 40.

FIG. 4 is a front view of the rear cover 60. That is, FIG. 4 is a view for illustrating an inner surface of the rear cover 60 when viewed from a front surface of the sheet cooling apparatus 1. The rear cover 60 being an exterior cover, which is configured to cover at least a part of the apparatus main body of the sheet cooling apparatus 1, covers a back surface of the main body frame 40. In this case, the front surface of the sheet cooling apparatus 1 refers to a side surface on which a front cover which is opened at the time of, for example, maintenance of the cooling unit 20 is provided and on which the cooling unit 20 is drawn. The rear cover 60 is formed of a metal plate having a thickness of from 0.8 mm to 1.2 mm. In this embodiment, dimensions of the rear cover 60 are approximately 500 mm in width×1,000 mm in height×100 mm in depth, and the weight of the rear cover 60 is from 4 kg to 5 kg.

The rear cover 60 has holes 70 through which screws are caused to pass so as to screw the rear cover 60 to the first rear cover mounting plate 49, the second rear cover mounting plates 50, and other mounting members. The holes 70 are each an elongated hole extending in a vertical direction. The rear cover 60 further includes a hook portion (engagement portion) 71, the first insertion portions (first protruding portions) 72, the second insertion portions (second protruding portions) 73, the positioning pins (positioning portions) 74, and a grip 75. The first insertion portions 72 are formed in the vicinities of the holes 70. In this embodiment, the first insertion portions 72 are formed below the holes 70. The first insertion portions 72 are each formed into a flat plate shape having a flat surface extending in a horizontal direction. The second insertion portions 73 are formed in the vicinities of the holes 70. In this embodiment, the second insertion portions 73 are formed above the holes 70. The second insertion portions 73 each have a flat plate shape having a flat surface extending in the horizontal direction. In this embodiment, the rear cover 60 is fixed to the main body frame 40 with ten screws so as to suppress radiation noise and correct distortion of the rear cover 60.

The hook portion 71 is formed on one end portion of the rear cover 60 on the upper side. The hook portion 71 is engaged with the engagement portion 81 formed in the rear upper cover mounting plate 48. Before the rear cover 60 is fixed with the screws, the rear cover 60 is supported on one end portion of the main body frame 40 so as to be rotatable about the hook portion 71. The positioning pins 74 are provided on another end portion of the rear cover 60 on the lower side.

The positioning pins 74 are inserted into the positioning holes 84 formed in another end portion of the main body frame 40 on the lower side, and the rear cover 60 is positioned with respect to the main body frame 40. The positioning pins 74 are provided on the lower side of the rear cover 60 as described above. Thus, a rotation angle of the rear cover 60 with respect to the main body frame 40 when the rear cover 60 is positioned with respect to the main body frame 40 can be made smaller than that in a case in which the positioning pins 74 are provided at the center or the upper side of the rear cover 60. Accordingly, an operator is not required to lift the rear cover 60, which is made of metal and is heavy, when positioning the rear cover 60 with respect to the main body frame 40, thereby improving the workability.

The first insertion portions 72 are inserted into the first catching portions 82 formed in the right upper stay 44 and the first rear cover mounting plate 49. The second insertion portions 73 are inserted into the second catching portions 83 formed in the second rear cover mounting plates 50.

The distance between the rear side plate 42 and the rear cover 60 is determined by fitting with an appearance surface of the image forming apparatus 2 or the sheet processing apparatus 3 to be coupled and the size of a built-in component such as the electrical unit 51. In this embodiment, the distance between the rear side plate 42 and the rear cover 60 is 200 mm. In order to secure a distance of 200 mm between the rear side plate 42 and the rear cover 60, the cost is lower when mounting components such as the second rear cover mounting plates 50 are added than when the height of each of the bent surfaces 42*a* of the rear side plate 42 is set high. In view of this, in this embodiment, the first rear cover mounting plate 49 and the second rear cover mounting plates 50 are mounted to the bent surfaces 42*a* of the rear side plate 42. However, the following configuration may be employed. Specifically, the first rear cover mounting plate 49 and the second rear cover mounting plates 50 are formed integrally with the bent surfaces 42*a* of the rear side plate 42, screw holes are formed in the bent surfaces 42*a* of the rear side plate 42, and the rear cover 60 is directly fixed to the rear side plate 42.

Here, when the rear side plate 42, the first rear cover mounting plate 49, and the second rear cover mounting plates 50 are separate members, the positions of the first rear cover mounting plate 49 and the second rear cover mounting plates 50 mounted to the bent surfaces 42*a* of the rear side plate 42 are liable to be influenced by the positional accuracy of the bent surfaces 42*a* of the rear side plate 42. Therefore, the positions of the screw holes 80 formed in the first rear cover mounting plate 49 and the second rear cover mounting plates 50 are liable to be deviated from predetermined positions in design. On the other hand, when the height of each of the bent surfaces 42*a* of the rear side plate 42 is high, the bent surfaces 42*a* to which the first rear cover mounting plate 49 and the second rear cover mounting plates 50 are mounted are elastically deformable. The positions of the screw holes 80 formed in the first rear cover mounting plate 49 and the second rear cover mounting plates 50 can be shifted within elastic deformation areas of the bent surfaces 42*a*, the first rear cover mounting plate 49, and the second rear cover mounting plates 50. Accordingly, position correction of from about 1 mm to about 3 mm is allowed in the positions of the screw holes 80 formed in the first rear cover mounting plate 49 and the second rear cover mounting plates 50. It is preferred that the rigidity of the first rear cover mounting plate 49 and the second rear cover mounting plates 50 be lower than the rigidity of the rear cover 60 under a state in which the first rear cover mounting plate 49 and the second rear cover mounting plates 50 are mounted to the main body frame 40.

(Method of Mounting Rear Cover to Main Body Frame)

Figure 5:
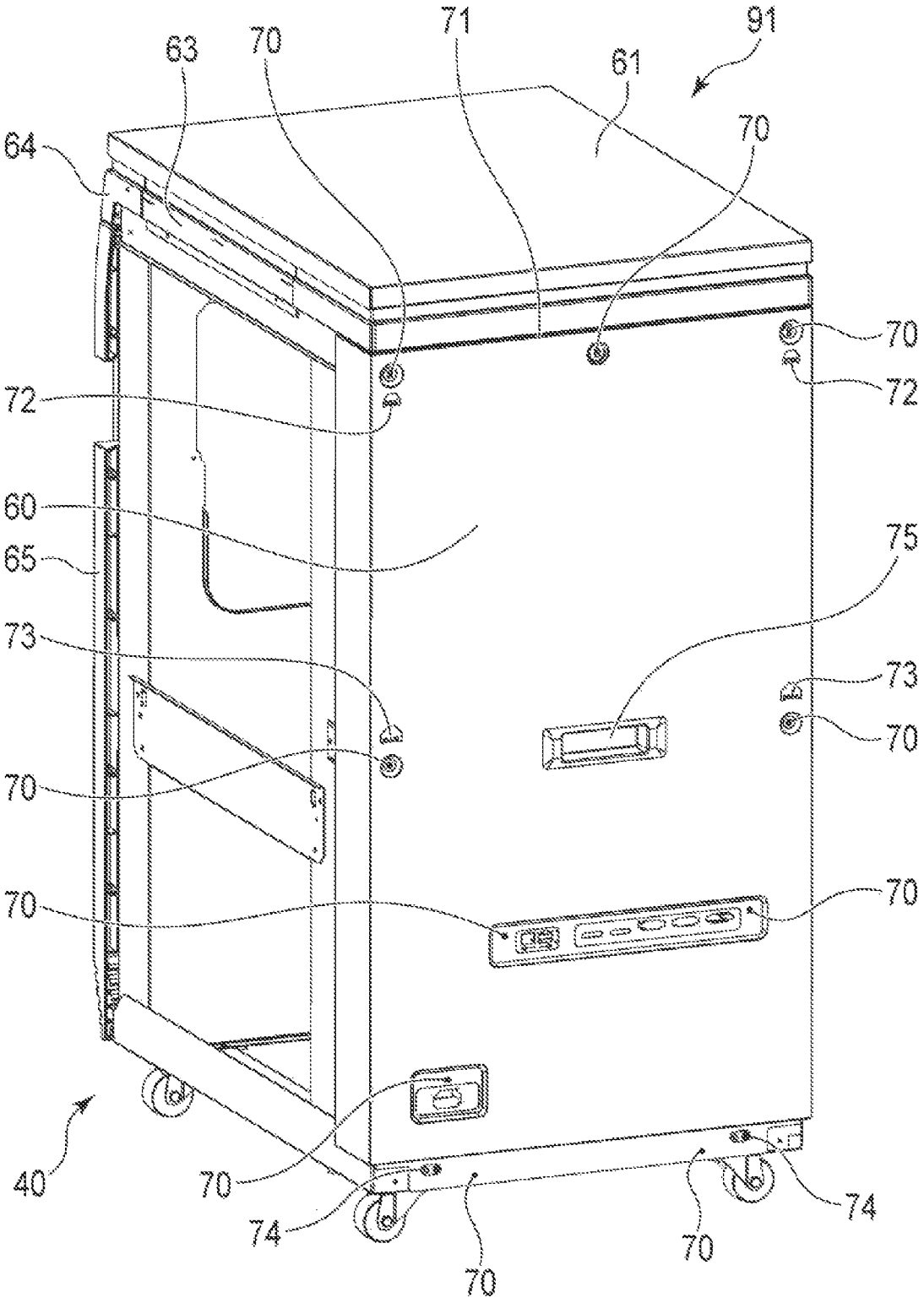
FIG. 5 is a perspective view of the main body frame to which the rear cover is mounted.
Figure 6:
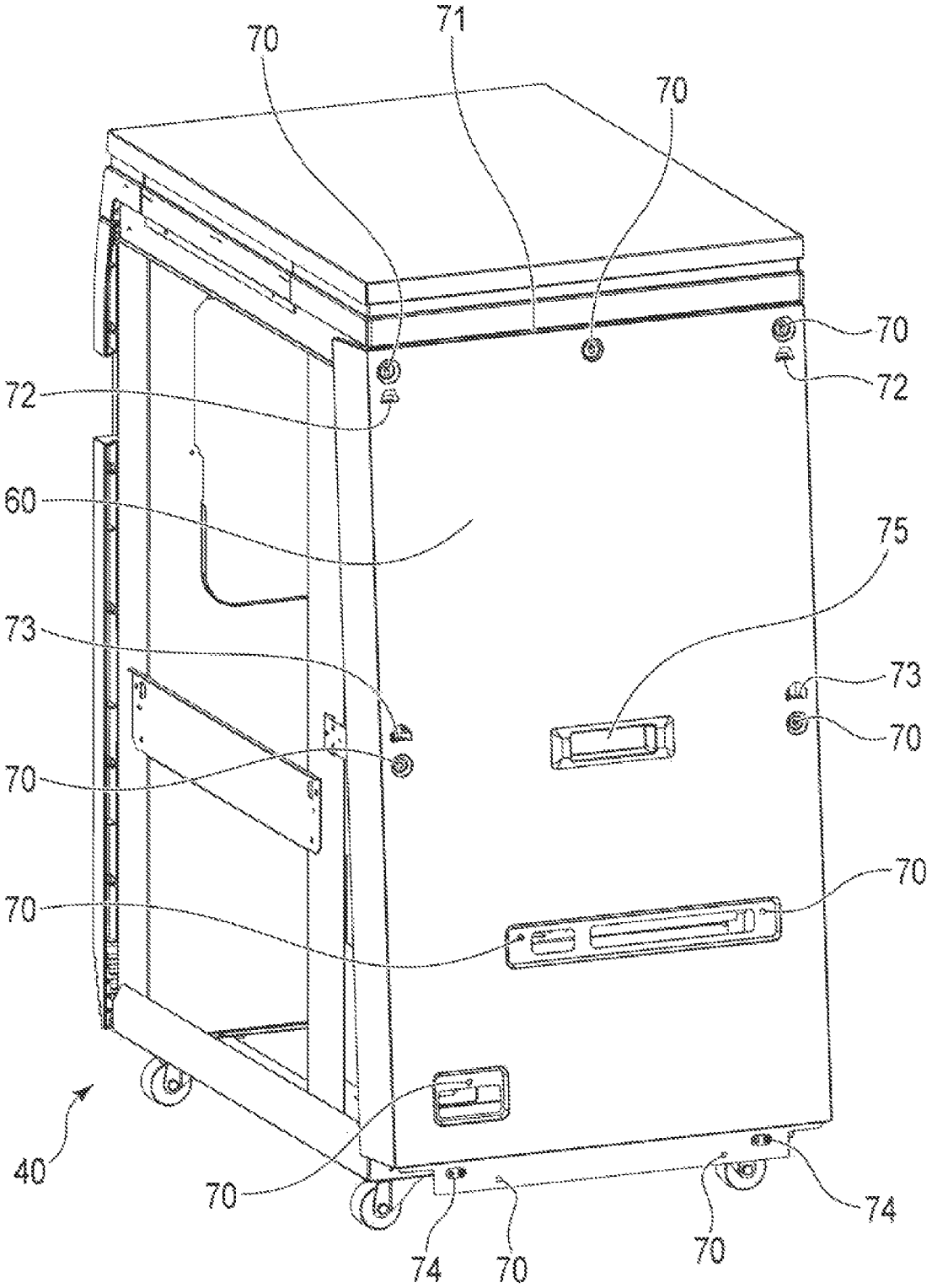
FIG. 6 is a perspective view for illustrating a state in which the rear cover is in the middle of being mounted to the main body frame.
Figure 7A:
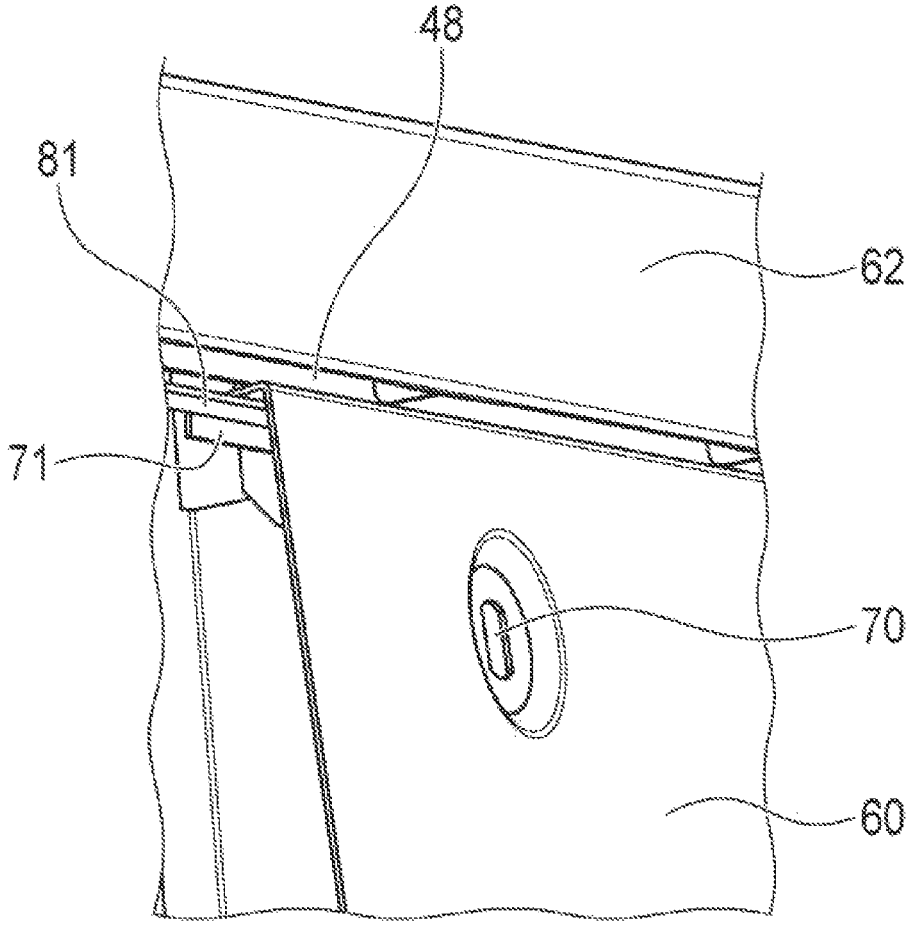
FIG. 7A is a perspective view of a hook portion of the rear cover which is engaged with an engagement portion of a rear upper cover mounting plate.
Figure 7B:
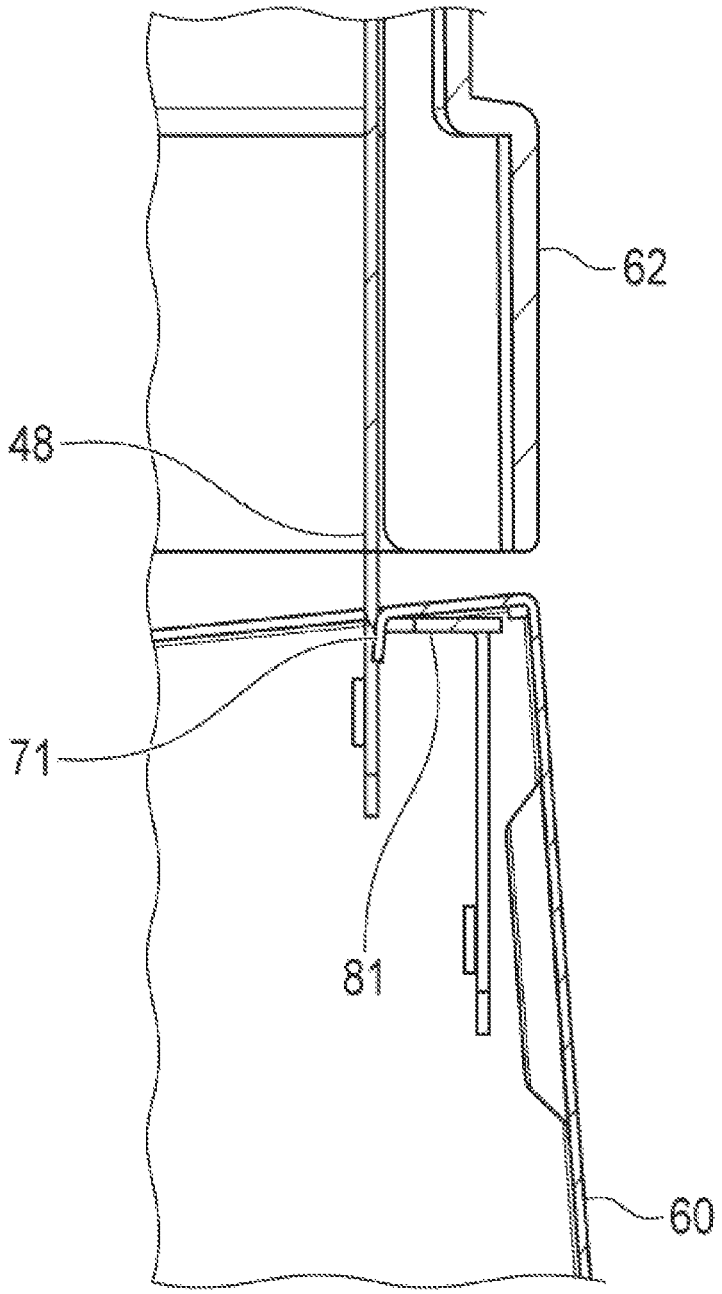
FIG. 7B is a sectional view of the hook portion of the rear cover which is engaged with the engagement portion of the rear upper cover mounting plate.

Now, with reference to FIG. 5 to FIG. 11B, a method of mounting the rear cover 60 to the main body frame 40 is described. FIG. 5 is a perspective view of the main body frame 40 to which the rear cover 60 is mounted. A casing 91 of the sheet cooling apparatus 1 includes the main body frame 40 and the rear cover 60. FIG. 6 is a perspective view for illustrating a state in which the rear cover 60 is in the middle of being mounted to the main body frame 40. FIG. 7A and FIG. 7B are enlarged views of the hook portion 71 of the rear cover 60 engaged with the engagement portion 81 of the rear upper cover mounting plate 48. FIG. 7A is a perspective view of the hook portion 71 engaged with the engagement portion 81. FIG. 7B is a sectional view of the hook portion 71 engaged with the engagement portion 81. In order to mount the rear cover 60 to the main body frame 40, an operator such as an assembly operator or a service person first hooks the hook portion 71 of the rear cover 60 on the engagement portion 81 of the rear upper cover mounting plate 48 while holding the grip 75 provided to the rear cover 60. With this, even when the operator releases his/her hand from the rear cover 60, the rear cover 60 is rotatably supported on the main body frame 40.

Figure 8A:
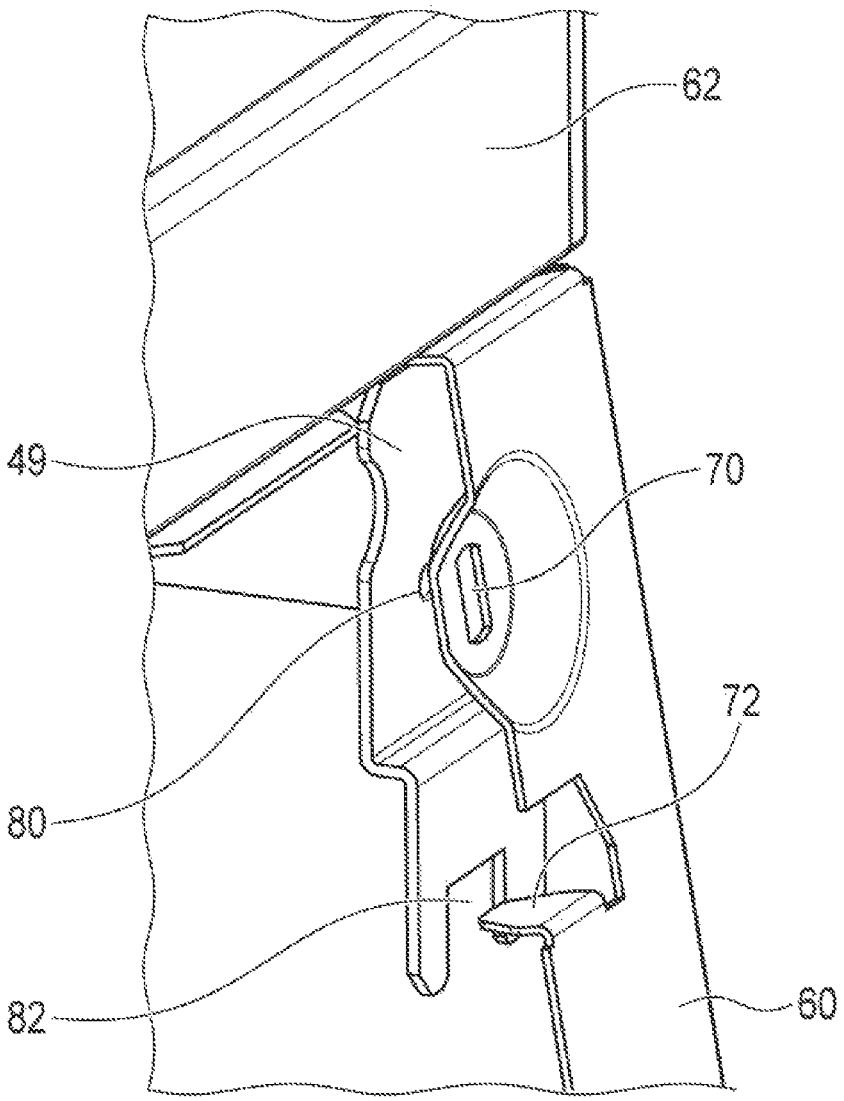
FIG. 8A is a perspective view of a first insertion portion and a first catching portion, for illustrating a state in which the first insertion portion is started to be inserted into the first catching portion.
Figure 8B:
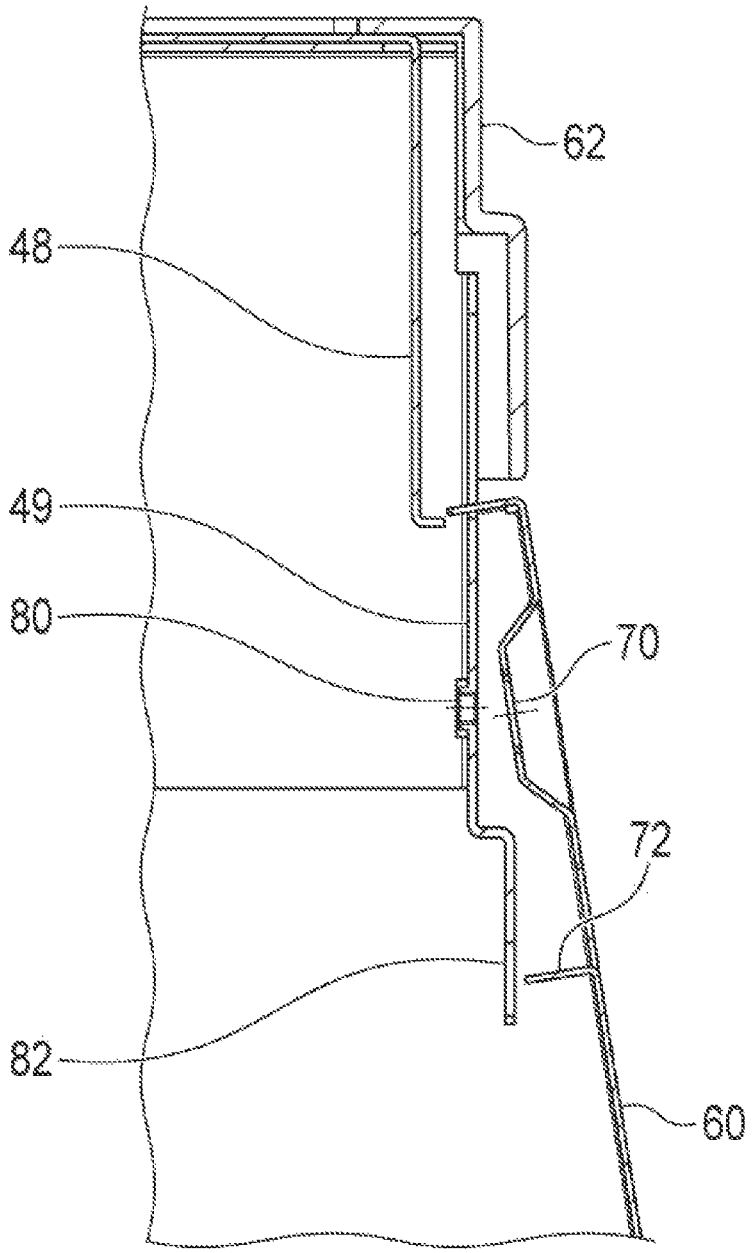
FIG. 8B is a sectional view of the first insertion portion and the first catching portion, for illustrating the state in which the first insertion portion is started to be inserted into the first catching portion.

FIG. 8A and FIG. 8B are enlarged views of the first insertion portion 72 and the first catching portion 82. FIG. 8A is a perspective view for illustrating a state in which the first insertion portion 72 of the rear cover 60 is started to be inserted into the first catching portion 82 of the first rear cover mounting plate 49. FIG. 8B is a sectional view for illustrating the state in which the first insertion portion 72 of the rear cover 60 is started to be inserted into the first catching portion 82 of the first rear cover mounting plate 49. Under a state in which the rear cover 60 is inclined with respect to the main body frame 40 by about 7°, the first insertion portions 72 formed in the rear cover 60 are started to be inserted into the first catching portions 82 formed in the right upper stay 44 and the first rear cover mounting plate 49. As the inclination angle of the rear cover 60 with respect to the main body frame 40 becomes smaller, through engagement between the first insertion portions 72 and the first catching portions 82, the positions of the holes 70 of the rear cover 60 and the screw holes 80 of the right upper stay 44 and the first rear cover mounting plate 49 in the horizontal direction are corrected.

Figure 9A:
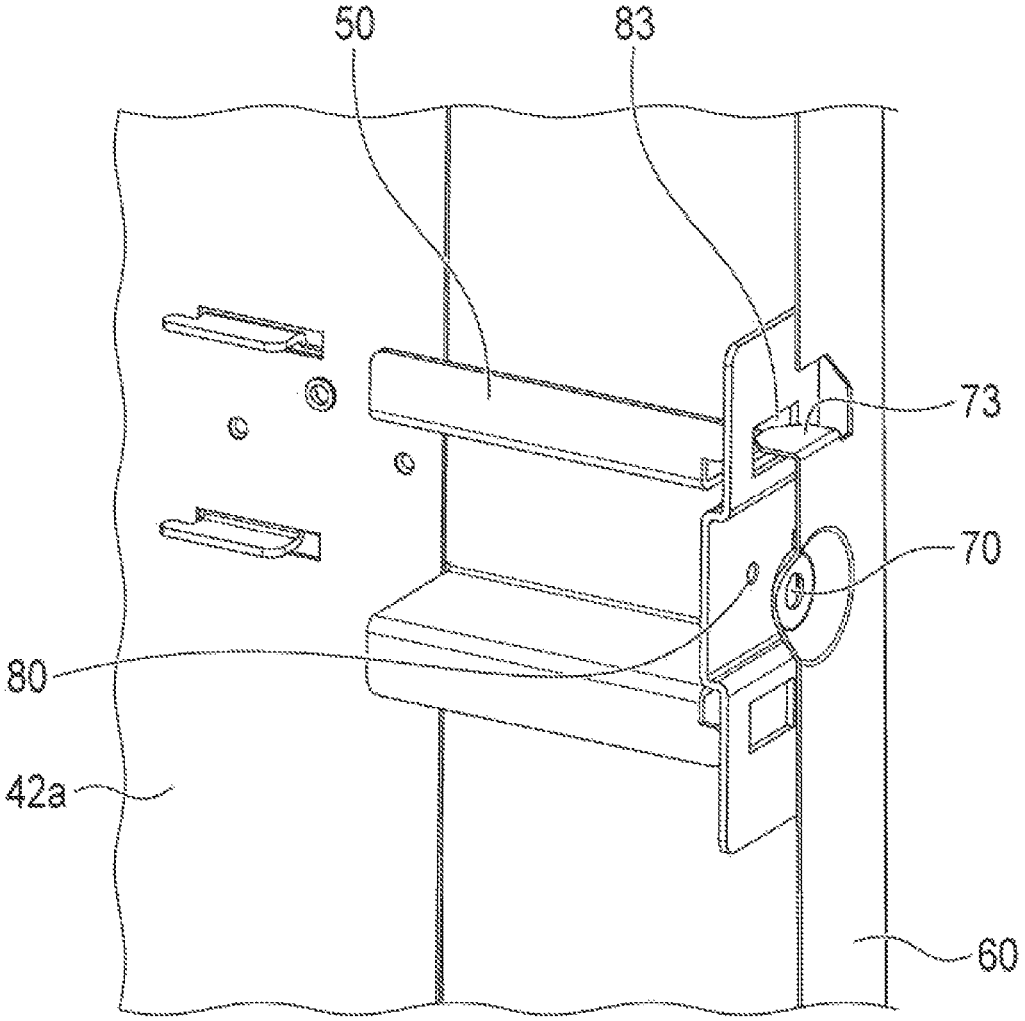
FIG. 9A is a perspective view of a second insertion portion and a second catching portion, for illustrating a state in which the second insertion portion is started to be inserted into the second catching portion.
Figure 9B:
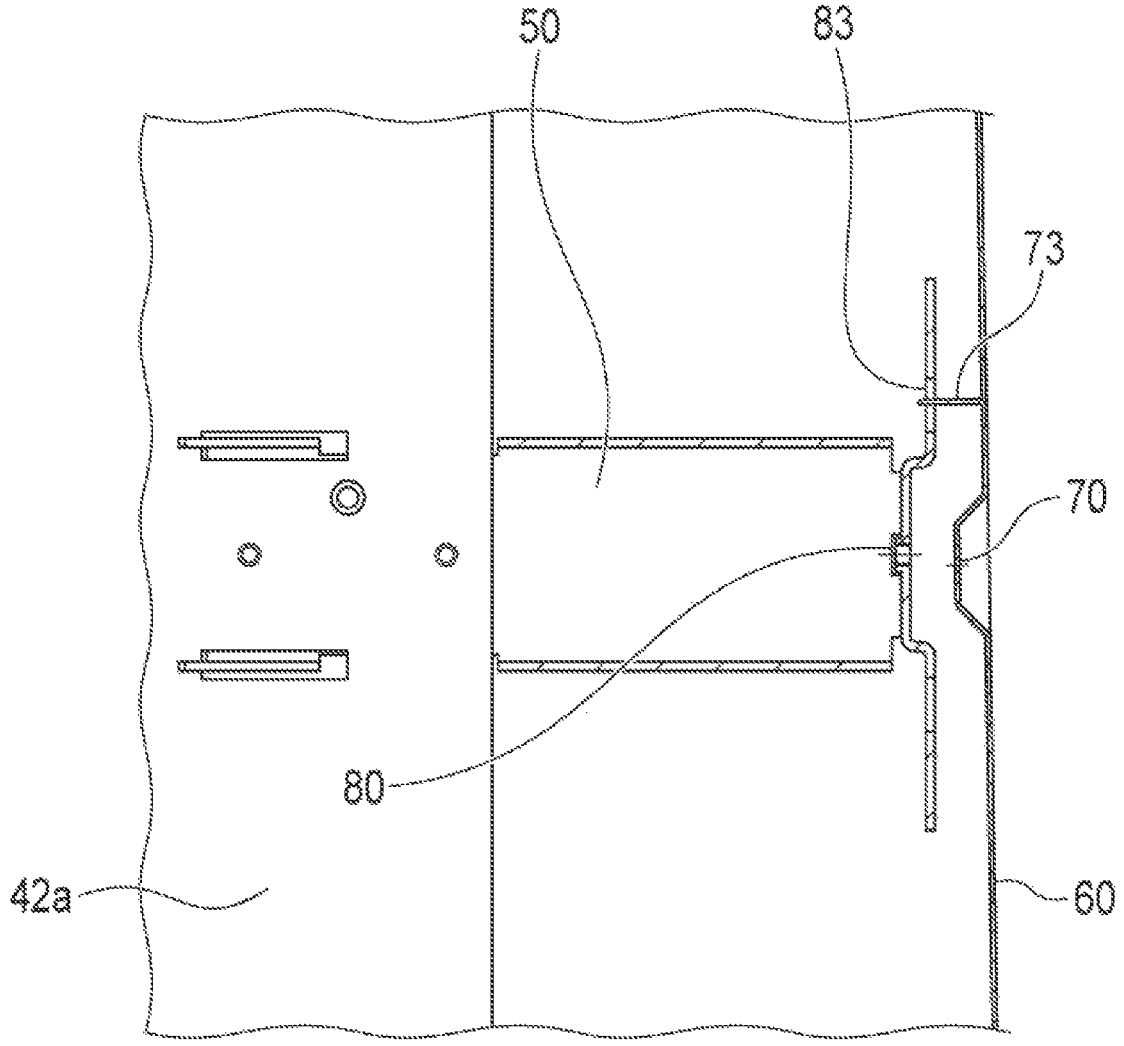
FIG. 9B is a sectional view of the second insertion portion and the second catching portion, for illustrating the state in which the second insertion portion is started to be inserted into the second catching portion.

FIG. 9A and FIG. 9B are enlarged views of the second insertion portion 73 and the second catching portion 83. FIG. 9A is a perspective view for illustrating a state in which the second insertion portion 73 of the rear cover 60 is started to be inserted into the second catching portion 83 of the second rear cover mounting plate 50. FIG. 9B is a sectional view for illustrating the state in which the second insertion portion 73 of the rear cover 60 is started to be inserted into the second catching portion 83 of the second rear cover mounting plate 50. Under a state in which the rear cover 60 is inclined with respect to the main body frame 40 by about 1°, the second insertion portion 73 formed in the rear cover 60 is started to be inserted into the second catching portion 83 formed in the second rear cover mounting plate 50. As the inclination angle of the rear cover 60 with respect to the main body frame 40 becomes smaller, through engagement between the second insertion portions 73 and the second catching portions 83, the positions of the holes 70 of the rear cover 60 and the screw holes 80 of the second rear cover mounting plates 50 in the horizontal direction are corrected.

Figure 10A:
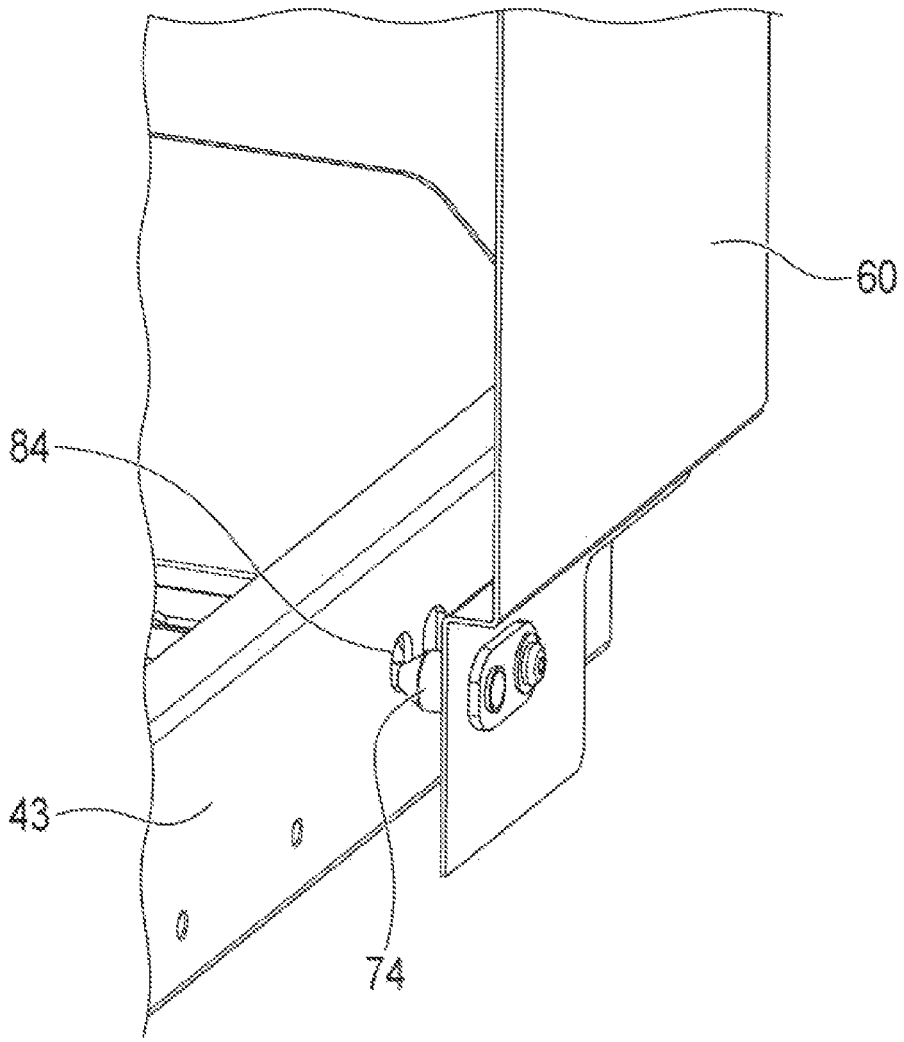
FIG. 10A is a perspective view of a positioning pin and a positioning hole, for illustrating a state in which the positioning pin is started to be inserted into the positioning hole.
Figure 10B:
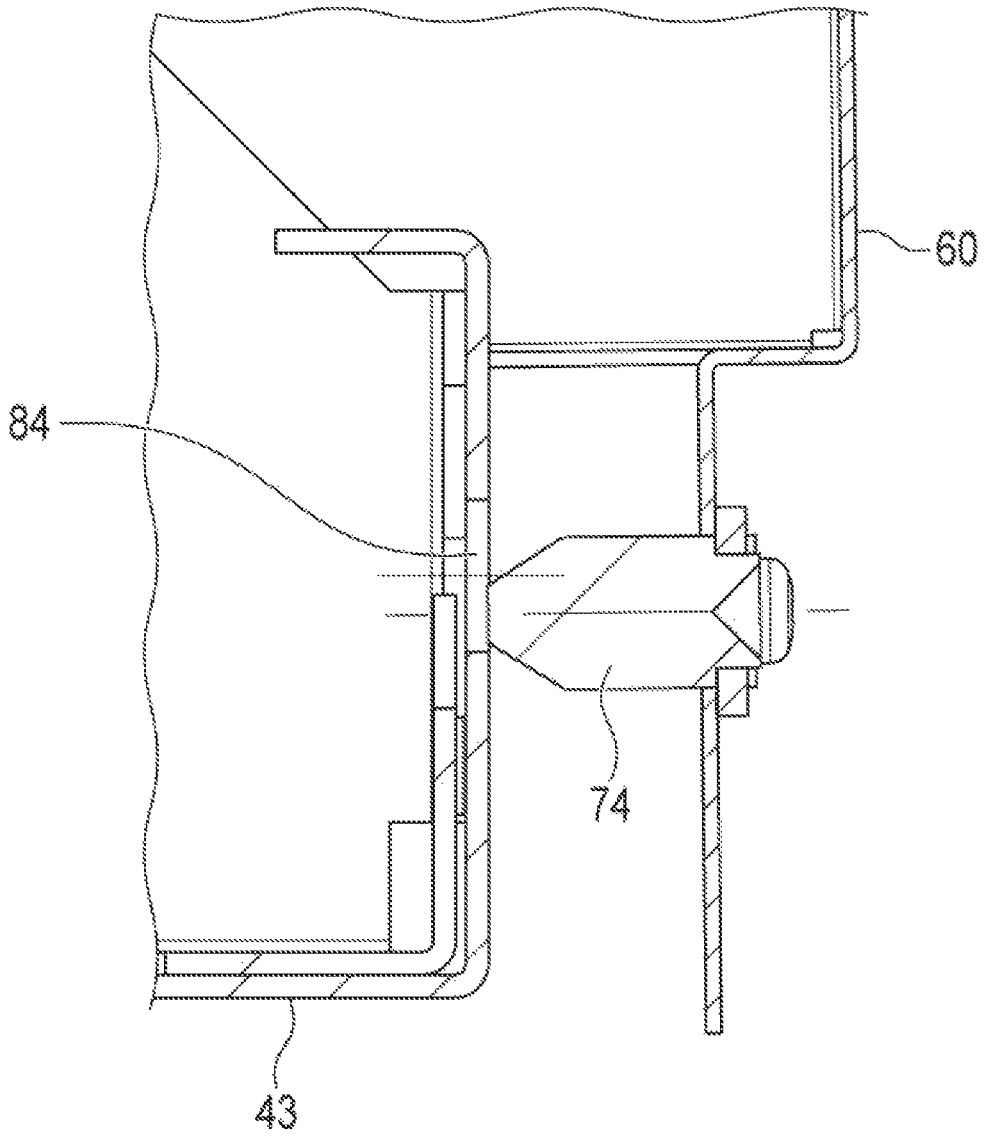
FIG. 10B is a sectional view of the positioning pin and the positioning hole, for illustrating the state in which the positioning pin is started to be inserted into the positioning hole.

FIG. 10A and FIG. 10B are enlarged views of the positioning pin 74 and the positioning hole 84 at the time of the start of insertion. FIG. 10A is a perspective view for illustrating a state in which the positioning pin 74 for the rear cover 60 is started to be inserted into the positioning hole 84 of the bottom plate 43. FIG. 10B is a sectional view for illustrating the state in which the positioning pin 74 for the rear cover 60 is started to be inserted into the positioning hole 84 of the bottom plate 43. Under a state in which the rear cover 60 is inclined with respect to the main body frame 40 by about 0.7°, the positioning pins 74 provided to the rear cover 60 are started to be inserted into the positioning holes 84 formed in the bottom plate 43.

Figure 11A:
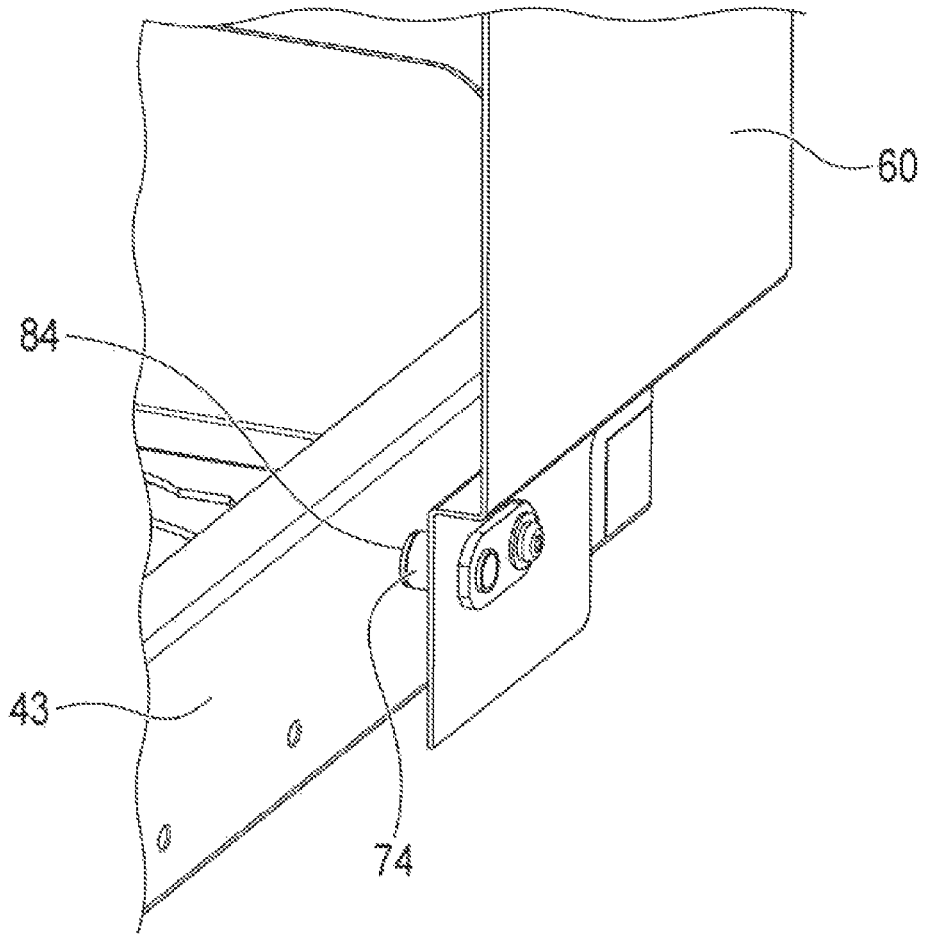
FIG. 11A is a perspective view of the positioning pin and the positioning hole under a state in which the insertion has been progressed.
Figure 11B:
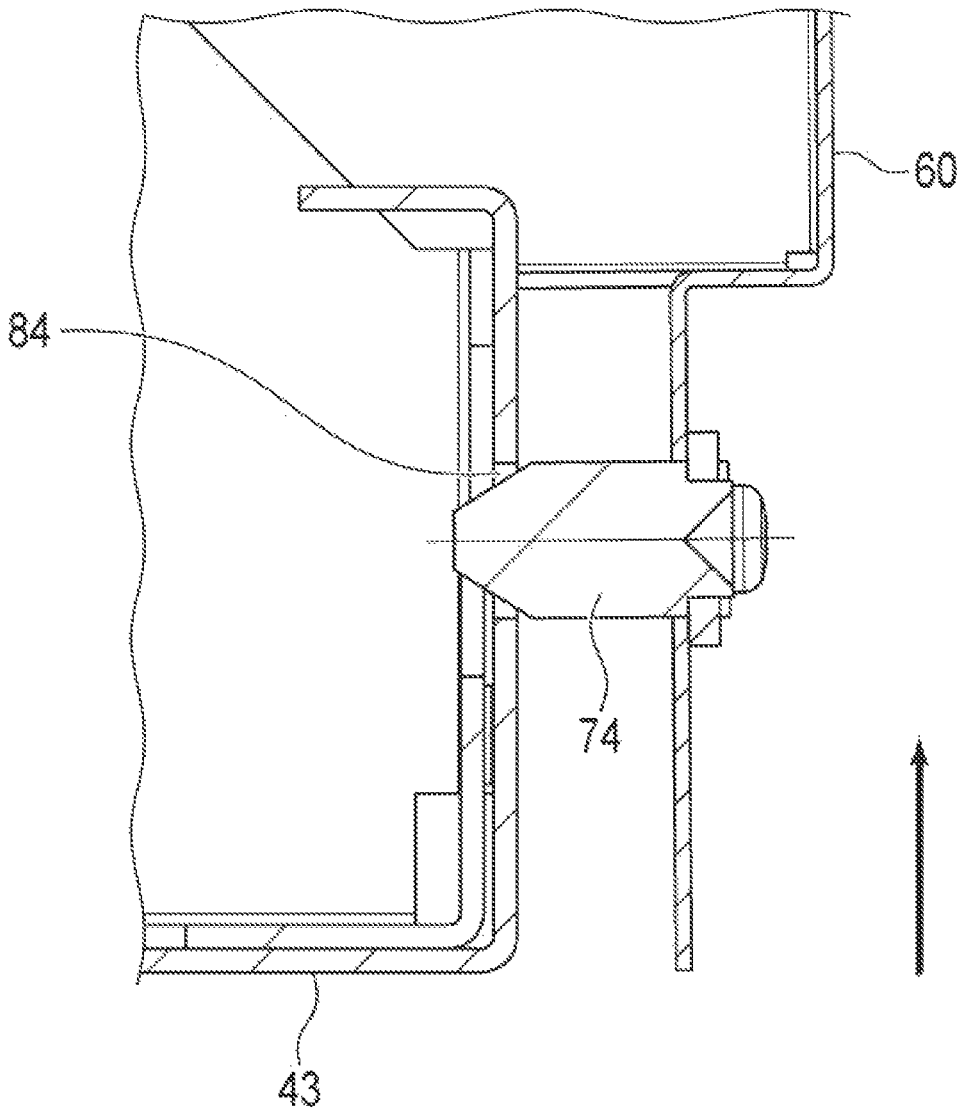
FIG. 11B is a sectional view of the positioning pin and the positioning hole under the state in which the insertion has been progressed.

FIG. 11A and FIG. 11B are enlarged views of the positioning pin 74 and the positioning hole 84 under a state in which the insertion has been progressed. FIG. 11A is a perspective view for illustrating a state in which the positioning pin 74 is inserted into the positioning hole 84 so that the position of the rear cover 60 is corrected. FIG. 11B is a sectional view for illustrating the state in which the positioning pin 74 is inserted into the positioning hole 84 so that the position of the rear cover 60 is corrected. As the insertion of the positioning pins 74 into the positioning holes 84 is progressed, through engagement between the positioning pins 74 and the positioning holes 84, the position of the rear cover 60 with respect to the main body frame 40 in the horizontal direction and a perpendicular direction is corrected.

(Description of Position Correction for Screw Holes)

Figure 12A:
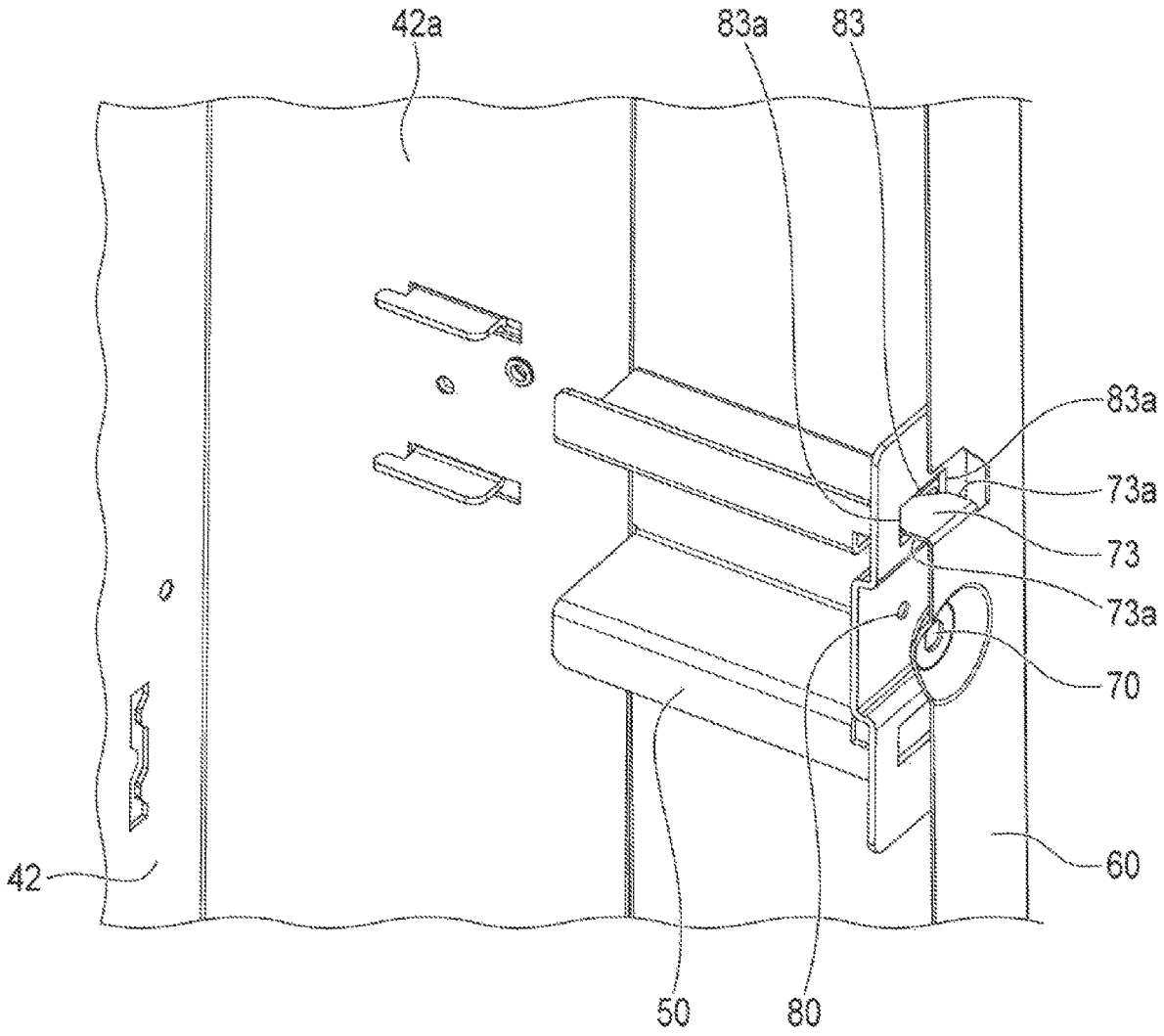
FIG. 12A is a perspective view of the second insertion portion and the second catching portion before the position correction.
Figure 12B:
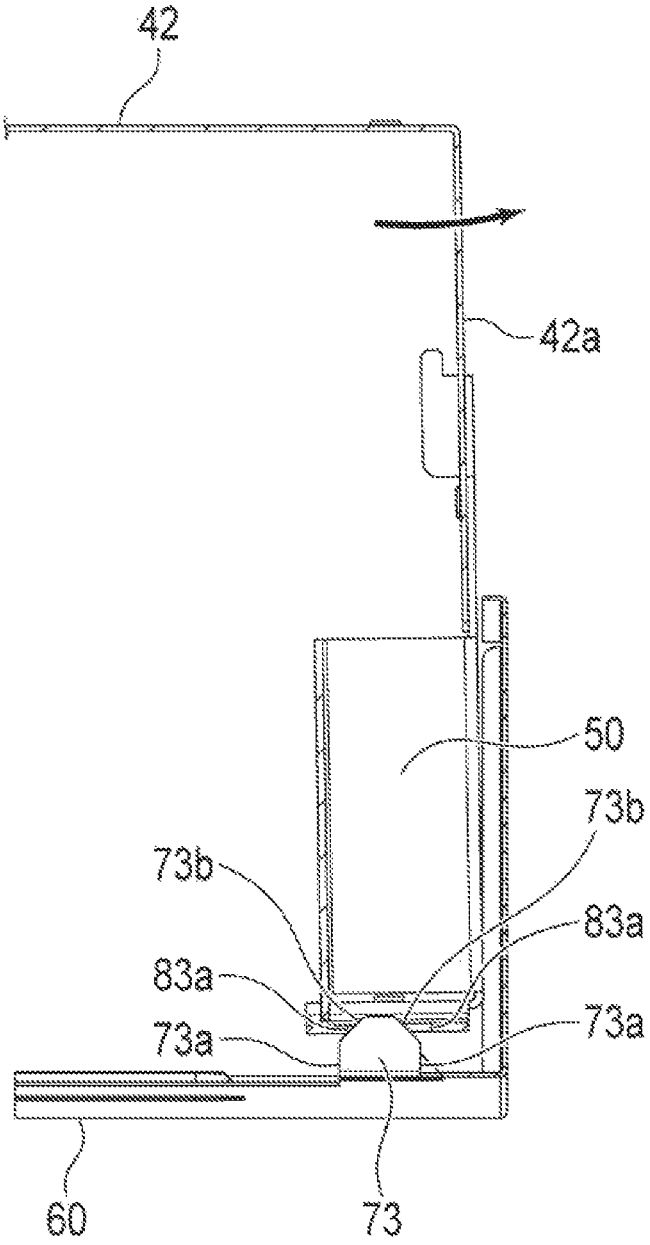
FIG. 12B is a sectional view of the second insertion portion and the second catching portion before the position correction.

Next, with reference to FIG. 12A, FIG. 12B, FIG. 13A, and FIG. 13B, position correction for the hole 70 of the rear cover 60 and the screw hole 80 of the second rear cover mounting plate 50 in the horizontal direction is described. FIG. 12A and FIG. 12B are enlarged views of the second insertion portion 73 and the second catching portion 83 before the position correction. FIG. 12A is a perspective view of the second insertion portion 73 and the second catching portion 83 before the position correction. FIG. 12B is a sectional view of the second insertion portion 73 and the second catching portion 83 before the position correction.

The second catching portion 83 of the second rear cover mounting plate 50 has catching surfaces 83*a* on both side portions in the horizontal direction. The second insertion portion 73 of the rear cover 60 has engagement surfaces 73*a* on both side portions in the horizontal direction. The engagement surfaces 73*a* extend in parallel from the connection portion with the rear cover 60. The second insertion portion 73 has a tapered shape, and has tapered surfaces 73*b* from the engagement surfaces 73*a* to the tip.

When the bent surface 42*a* of the rear side plate 42 is open at an obtuse angle, the screw hole 80 of the second rear cover mounting plate 50 mounted to the bent surface 42*a* is shifted to the right side in the horizontal direction with respect to the hole 70 of the rear cover 60. When the second insertion portion 73 of the rear cover 60 is inserted into the second catching portion 83 of the second rear cover mounting plate 50, as illustrated in FIG. 12A and FIG. 12B, the tapered surfaces 73*b* of the second insertion portion 73 are brought into contact with the catching surfaces 83*a* of the second catching portion 83. The tapered surface 73*b* on one side (left side) is brought into abutment against the catching surface 83*a* on one side (left side). When the second insertion portion 73 is further inserted into the second catching portion 83, the bent surface 42*a* of the rear side plate 42 is deformed within the elastic deformation area.

Figure 13A:
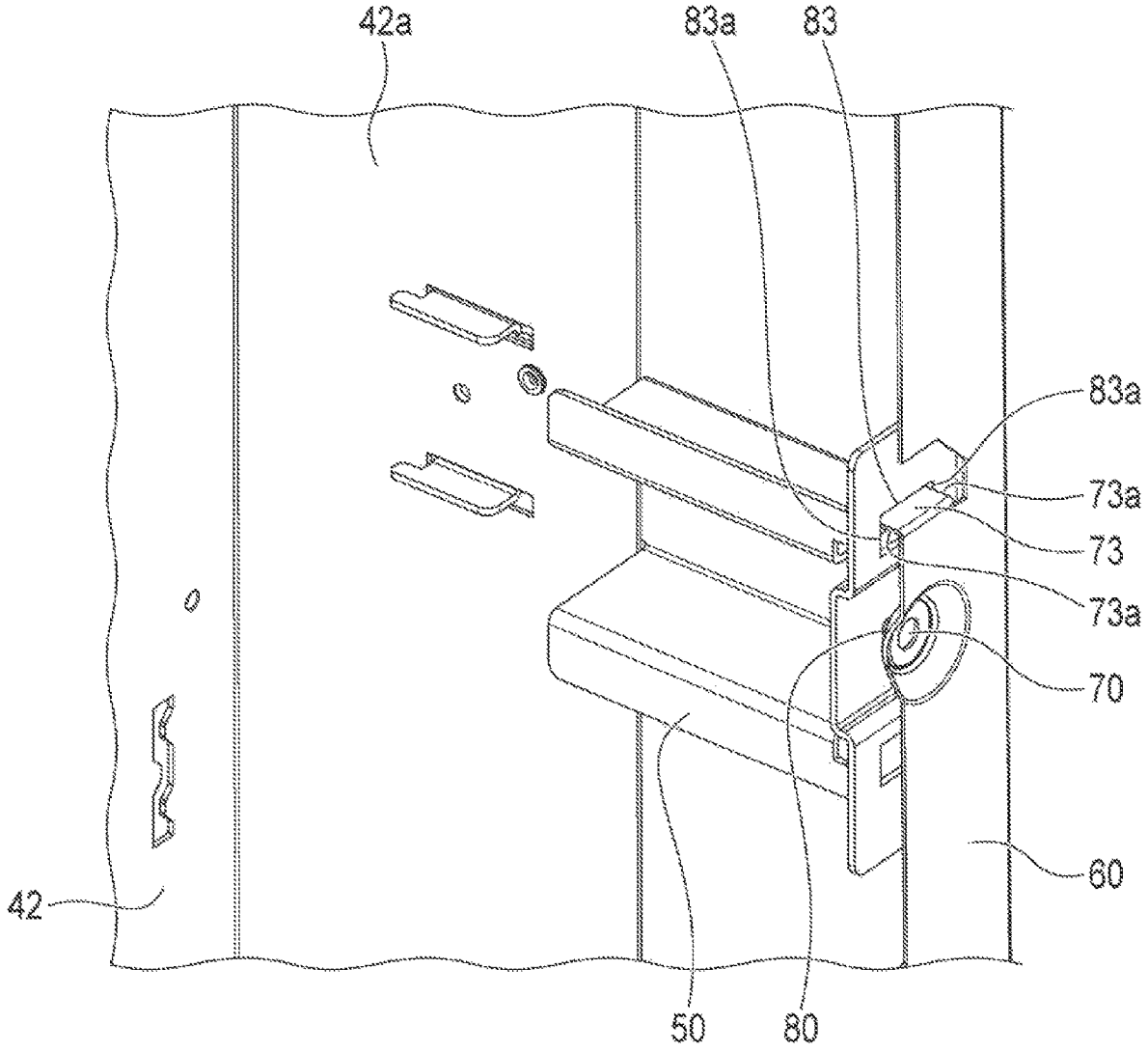
FIG. 13A is a perspective view of the second insertion portion and the second catching portion after the position correction.
Figure 13B:
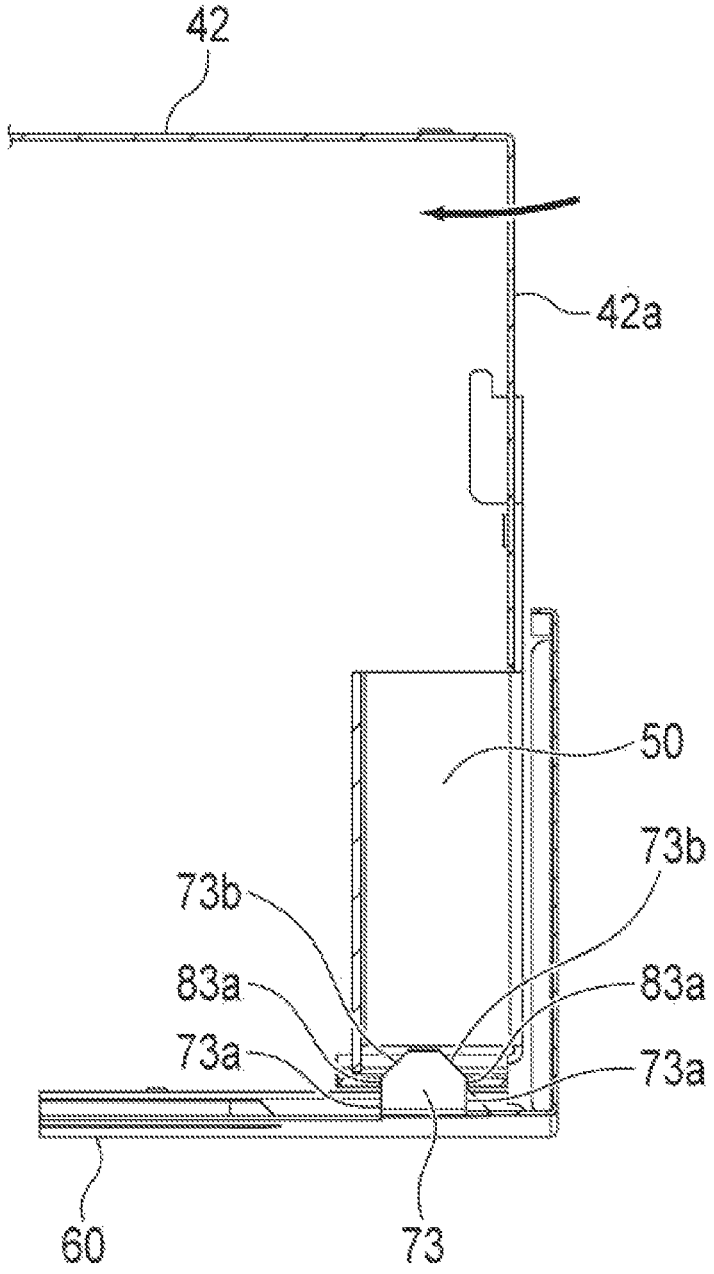
FIG. 13B is a sectional view of the second insertion portion and the second catching portion after the position correction.

FIG. 13A and FIG. 13B are enlarged views of the second insertion portion 73 and the second catching portion 83 after the position correction. FIG. 13A is a perspective view of the second insertion portion 73 and the second catching portion 83 after the position correction. FIG. 13B is a sectional view of the second insertion portion 73 and the second catching portion 83 after the position correction. When the second insertion portion 73 is further inserted into the second catching portion 83, and the engagement surfaces 73*a* of the second insertion portion 73 are engaged with the catching surfaces 83*a* of the second catching portion 83, the deformation of the bent surfaces 42*a* of the rear side plate 42 within the elastic deformation area is completed. The position of the screw hole 80 of the second rear cover mounting plate 50 in the horizontal direction with respect to the hole 70 of the rear cover 60 is corrected.

In this embodiment, the rear cover 60 is positioned with respect to the main body frame 40 while being rotated with respect to the main body frame 40 assembled with high accuracy. Further, position correction (from about 1 mm to about 3 mm) in the horizontal direction is allowed for the right upper stay 44, the first rear cover mounting plate 49, and the second rear cover mounting plates 50, which are liable to be influenced by the positional accuracy of the bent surfaces 42*a* of the rear side plate 42, within the elastic deformation area of the rear side plate 42. The positions of the holes 70 formed in the rear cover 60 and the positions of the screw holes 80 formed in the right upper stay 44, the first rear cover mounting plate 49, and the second rear cover mounting plates 50 are corrected to positions that allow screwing. Accordingly, it is not required to use an assembly jig at the time of assembly by an assembly operator at a factory or temporarily fix the rear cover 60 with screws in order to fix the rear cover 60 at the time of assembly by a service person, thereby improving the ease of assembly and the ease of maintenance of the casing 91.

In this embodiment, the rear cover 60 is fixed to the main body frame 40 with ten screws, and the rear cover 60 has four insertion portions (first insertion portions 72 and second insertion portions 73). However, the number of screws and the number of insertion portions are not limited thereto. Further, in this embodiment, the casing 91 of the sheet cooling apparatus 1 has been described. However, this embodiment can also be applied to casings of the image forming apparatus 2, the sheet processing apparatus 3, and the external feeding apparatus 4. Further, the above-mentioned embodiment may be applied to a reading apparatus configured to read an image formed on a sheet as a sheet conveying apparatus. In this case, as the configuration of the image forming system, it is conceivable to employ a configuration in which the image reading apparatus is coupled to a downstream side of the image forming apparatus 2, and a configuration in which the image reading apparatus is coupled to a further downstream side of the sheet cooling apparatus 1 coupled to the downstream side of the image forming apparatus 2. Such an image reading apparatus is an apparatus which is connected to the image forming apparatus 2 so as to detect misregistration or a tinge of an image formed on a sheet by the image forming apparatus 2. In the image reading apparatus, a conveyance unit includes a conveyance roller pair configured to receive and convey the sheet having the image formed thereon by the image forming apparatus 2, and a reading unit provided on a downstream side of the conveyance roller pair.

According to this embodiment, the rear cover (exterior cover) 60 is positioned with respect to the main body frame 40 while being rotated, and the position correction of the screw holes 80 can also be performed. Thus, the ease of assembly and the ease of maintenance of the casing 91 can be improved. In this embodiment, the rear cover 60 of the casing 91 has been described. However, this embodiment is not limited to the rear cover 60, and can be applied to a front cover or a side cover of the casing 91. According to this embodiment, the ease of assembly and the ease of maintenance of the casing can be improved.

According to this embodiment, workability during assembly and maintenance of the sheet conveying apparatus can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-074724, filed Apr. 20, 2020, which is hereby incorporated by reference herein in its entirety.

What is claimed is:

1. A sheet conveying apparatus comprising:

a conveyance unit configured to convey a sheet;

a support frame provided with a mounting member and configured to support the conveyance unit; and an exterior cover configured to cover the support frame on a back side of the sheet conveying apparatus, where the exterior cover is made of metal and is fixed to the mounting member by a screw, wherein the exterior cover includes a hook portion provided above a position corresponding to the mounting member in a vertical direction, and a positioning pin provided below the position corresponding to the mounting member in the vertical direction, and wherein the support frame includes an engagement portion, provided at a position above the mounting member in the vertical direction, with which the hook portion is engaged, and a through-hole, formed at a position below the mounting member in the vertical direction, into which the positioning pin is inserted to position the exterior cover with respect to the support frame.

2. The sheet conveying apparatus according to claim 1, wherein the mounting member is provided with a screw hole with which the screw is engaged, wherein the exterior cover is provided with an elongated hole elongated in the vertical direction, and wherein the screw is fastened to the elongated hole and the screw hole.

3. The sheet conveying apparatus according to claim 2, wherein a rigidity of the mounting member is lower than a rigidity of the exterior cover, and wherein a position of the screw hole with respect to the elongated hole is corrected within an elastic deformation area of the mounting member mounted to the support frame.

4. The sheet conveying apparatus according to claim 1, wherein, in a state before the screw is fixed, the exterior cover is rotatable about the hook portion with respect to the support frame.

5. The sheet conveying apparatus according to claim 1, wherein the exterior cover is formed of a metal plate.

6. The sheet conveying apparatus according to claim 1, wherein the mounting member is formed of a metal plate.

7. The sheet conveying apparatus according to claim 1, wherein the support frame further includes a support surface configured to support the conveyance unit, and a side plate having a bent surface bent so as to rise with respect to the support surface, and wherein the mounting member is fixed to the bent surface.

8. The sheet conveying apparatus according to claim 1, wherein the positioning pin has a tapered surface which is tapered toward a tip.

9. The sheet conveying apparatus according to claim 1, wherein the conveyance unit includes a conveyance roller pair, and an image reading unit provided on a downstream side of the conveyance roller pair in a sheet conveyance direction and configured to read an image formed on the sheet.

10. The sheet conveying apparatus according to claim 1, wherein the conveyance unit includes a pair of belt units configured to nip and convey the sheet, and a heatsink in contact with a belt inner circumferential surface of at least one of the pair of belt units.

11. An image forming system comprising:

an image forming apparatus configured to form an image on a sheet; and a sheet conveying apparatus configured to receive the sheet discharged from the image forming apparatus and convey the sheet to a downstream side, wherein the sheet conveying apparatus includes:

a conveyance unit configured to convey the sheet, a support frame provided with a mounting member and configured to support the conveyance unit, and an exterior cover configured to cover the support frame on a back side of the sheet conveying apparatus, the exterior cover being made of metal and being fixed to the mounting member by a screw, wherein the exterior cover includes a hook portion provided above a position corresponding to the mounting member in a vertical direction, and a positioning pin provided below the position corresponding to the mounting member in the vertical direction, and wherein the support frame includes an engagement portion, provided at a position above the mounting member in the vertical direction, with which the hook portion is engaged, and a through-hole, formed at a position below the mounting member in the vertical direction, into which the positioning pin is inserted to position the exterior cover with respect to the support frame.

* * * * *